US007677910B2

(12) United States Patent
Yoshida et al.

(10) Patent No.: US 7,677,910 B2
(45) Date of Patent: Mar. 16, 2010

(54) CONNECTOR CONNECTION APPARATUS

(75) Inventors: Haruki Yoshida, Shizuoka (JP); Eiji Fukuda, Shizuoka (JP); Sumito Atsumi, Shizuoka (JP); Hiroshi Kobayashi, Aichi (JP); Kiyoka Matsubayashi, Aichi (JP); Fumitoshi Akaike, Aichi (JP); Masatoshi Mori, Aichi (JP)

(73) Assignees: Yazaki Corporation, Tokyo (JP); Toyota Jidosha Kabushiki Kaisha, Toyota (JP); Toyota Boshoku Kabushiki Kaisha, Kariya (JP)

( * ) Notice: Subject to any disclaimer, the term of this patent is extended or adjusted under 35 U.S.C. 154(b) by 122 days.

(21) Appl. No.: 11/893,863

(22) Filed: Aug. 17, 2007

(65) Prior Publication Data

US 2008/0054701 A1 Mar. 6, 2008

(30) Foreign Application Priority Data

Aug. 23, 2006 (JP) ..... 2006-226581

(51) Int. Cl.
*H01R 13/64* (2006.01)

(52) U.S. Cl. ..... 439/246; 439/335; 439/701

(58) Field of Classification Search ..... 439/246–248, 439/335, 533, 701
See application file for complete search history.

(56) References Cited

U.S. PATENT DOCUMENTS 6,364,681 B1 * 4/2002 Watanabe ..... 439/335

FOREIGN PATENT DOCUMENTS

| | | |
|---|---|---|
| JP | 10-189156 | 7/1998 |
| JP | 11-260468 | 9/1999 |
| JP | 2003-299549 | 10/2003 |
| JP | 2005-212653 | 8/2005 |

* cited by examiner

*Primary Examiner*—Tho D Ta
(74) *Attorney, Agent, or Firm*—Kratz, Quintos & Hanson, LLP

(57) ABSTRACT

The present invention is to provide a connector connection apparatus to avoid drop of a connector without increase of cost. The connector connection apparatus includes a holder for receiving therein and holding the connector, a receiving portion main body for receiving therein and holding the holder, and a plate for fixing the holder attached to the receiving portion main body. The receiving portion main body includes a receiving hole having a diameter larger than an outer diameter of the holder and receiving the holder therein. The holder is inserted from an upper opening of the receiving hole into the receiving portion main body. The holder is then held between the plate and the receiving portion main body.

6 Claims, 8 Drawing Sheets

CONNECTOR CONNECTION APPARATUS

BACKGROUND OF THE INVENTION

1. Field of the Invention

The present invention relates to a connector connection apparatus having a connector.

2. Description of the Related Art

A motor vehicle has an electronic apparatus such as a monitor or a whiplash preventing apparatus in a headrest. A variety of connector connection apparatuses are utilized for supplying electrical power or signal to the electronic apparatus attached to the headrest.

The conventional connector connection apparatus includes a cylindrical sleeve, or a receiving member attached to a seat, a connector received in the sleeve, a pole attached to the headrest, and a mating connector attached to an end of the pole. The pole is inserted into the sleeve to connect the connector to the mating connector. The conventional connector connection apparatus thereby supplies the electrical power or signal of the vehicle main body to the electronic apparatus of the headrest.

In the conventional connector connection apparatus, it is necessary to make the connector movable in the sleeve in order to assuredly connect the connectors together when the headrest is moved close to the seat. It is necessary to form engaging projections and engaging arms on an inner wall of the sleeve and outer walls of the both connectors to make the connectors movable in the sleeve and avoid drop of the connector from the sleeve. The resulting sleeve and connectors become complicated and increase the cost of the product.

SUMMARY OF THE INVENTION

An object of the present invention is to provide a connector connection apparatus holding movably a connector therein without increase of cost.

According to a first aspect of the present invention, a connector connection apparatus includes: a holder for receiving therein and holding a connector; a receiving member for receiving therein and holding the holder; and a fixing member for fixing the holder attached to the receiving member, wherein the receiving member has a receiving hole with a diameter larger than an outer diameter of the holder by a gap for receiving the holder, the holder is insertable through an upper opening of the receiving hole into the receiving member, and a fixing member is attachable to the receiving member so as to fix the holder between the fixing member and the receiving member in the insertion direction of the holder.

Preferably, the receiving member includes a locking portion for locking one end portion of the fixing member and a fixing portion for fixing another end portion of the fixing member with a bolt.

Preferably, the holder is movable in the receiving hole when the connector is connected to a mating connector.

Preferably, the receiving member has a bottom plate for holding the holder with the fixing member, the bottom plate being connected with a lower opening of the receiving hole.

Preferably, the holder is insertable from the upper opening of the receiving hole into the receiving member.

Preferably, the holder includes a pair of engaging arms disposed with a distance for engaging the connector, and a connection portion for connecting the engaging arms together.

Preferably, the connector is disposed on a seat and the mating connector is disposed on a headrest.

DETAILED DESCRIPTION OF THE PREFERRED EMBODIMENT

FIGS. 1-8 show an embodiment of a connector connection apparatus, hereafter referred to connection apparatus, of the present invention. The connection apparatus is utilized for supplying a desired electrical power or signal to electronic apparatuses such as monitors or whiplash-preventing device mounted on a headrest of a motor vehicle.

Figure 1:
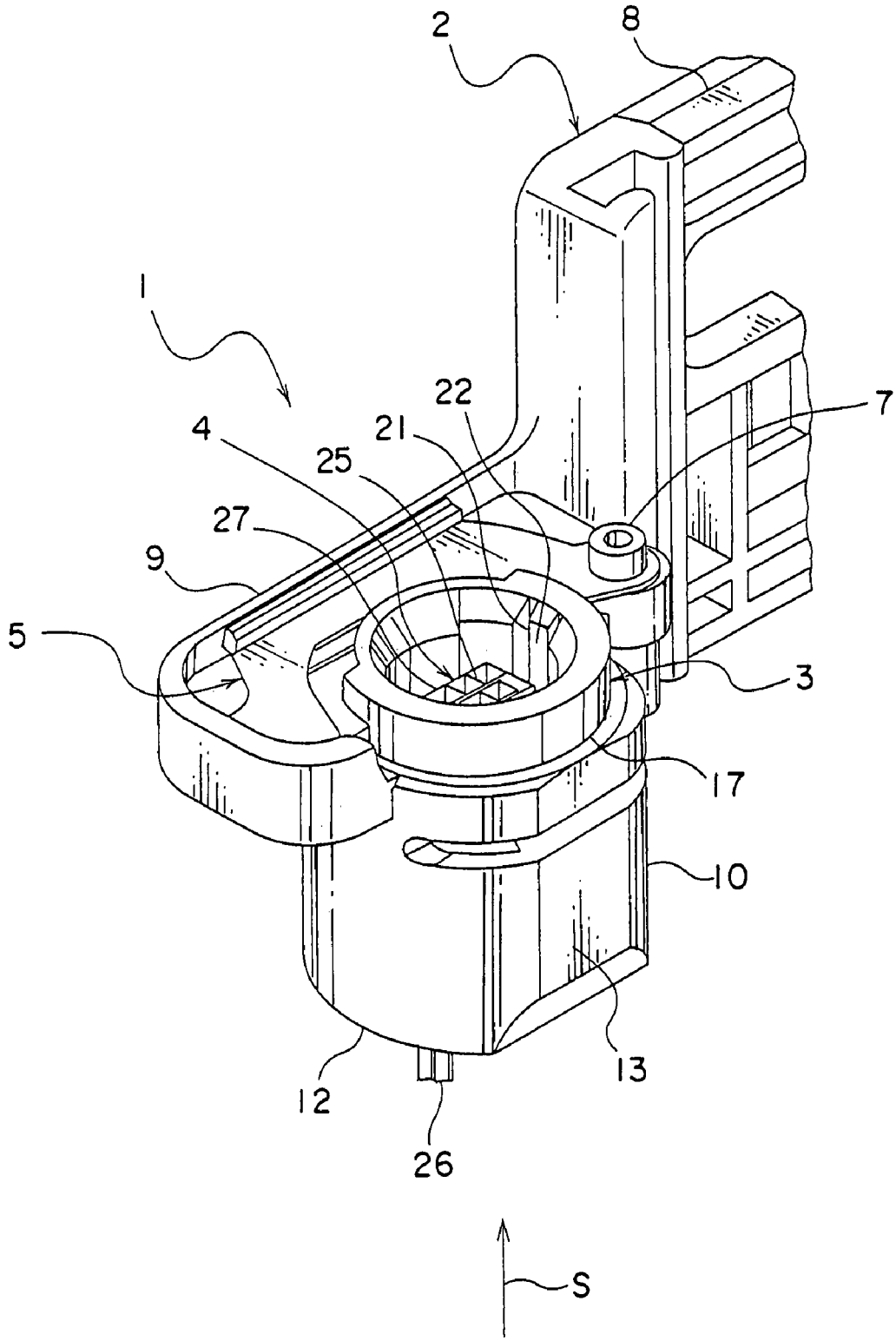
FIG. 1 is a perspective view showing an embodiment of a connector connection apparatus of the present invention.
Figure 2:
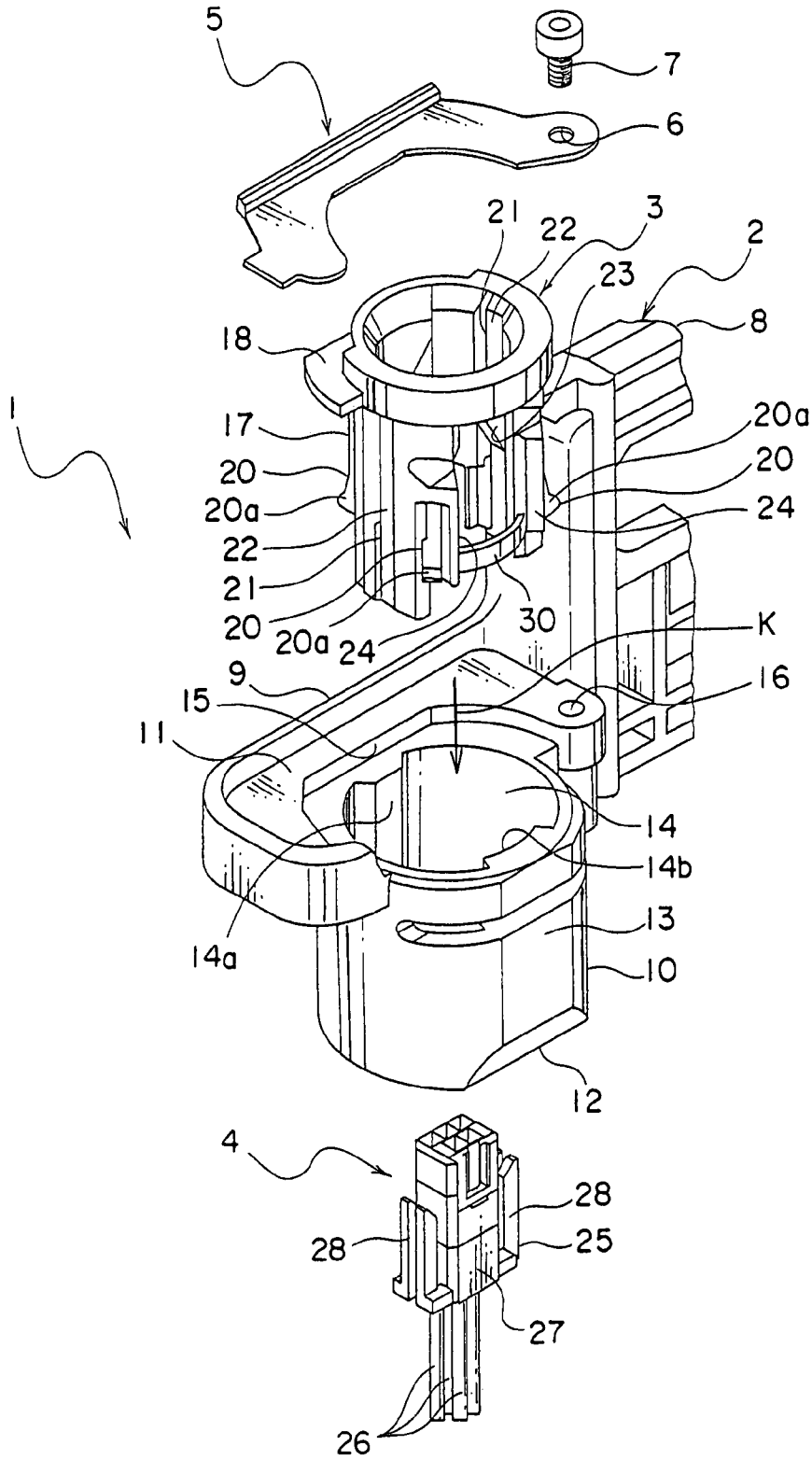
FIG. 2 is an exploded perspective view of the connector connection apparatus of FIG. 1.

Referring to FIGS. 1-2, the connection apparatus 1 includes a bracket 2, a holder 3, a connector 4, a plate 5 (fixing member), and a bolt 7.

Figure 5:
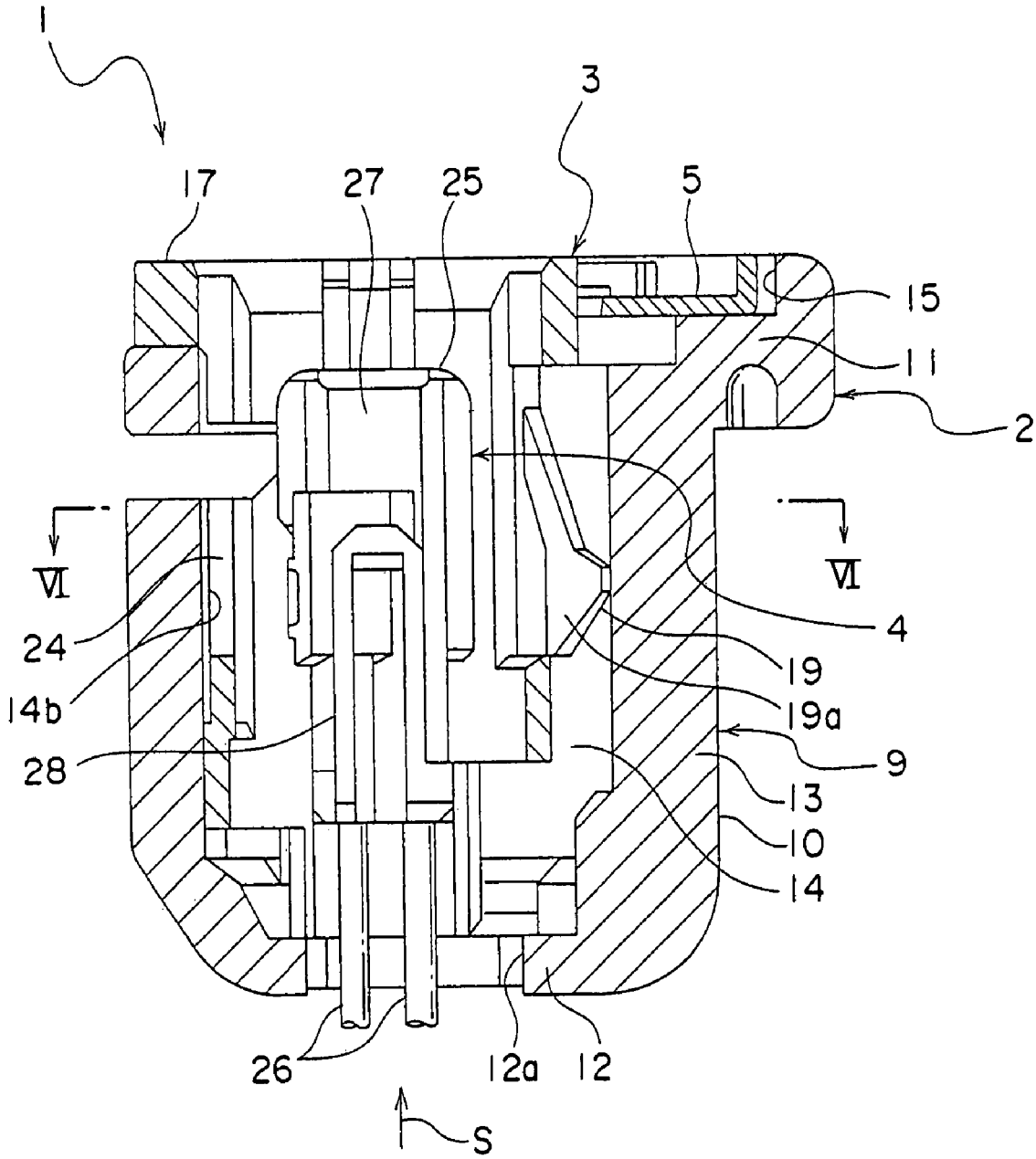
FIG. 5 is a cross-sectional view taken along line V-V of FIG. 3.
Figure 6:
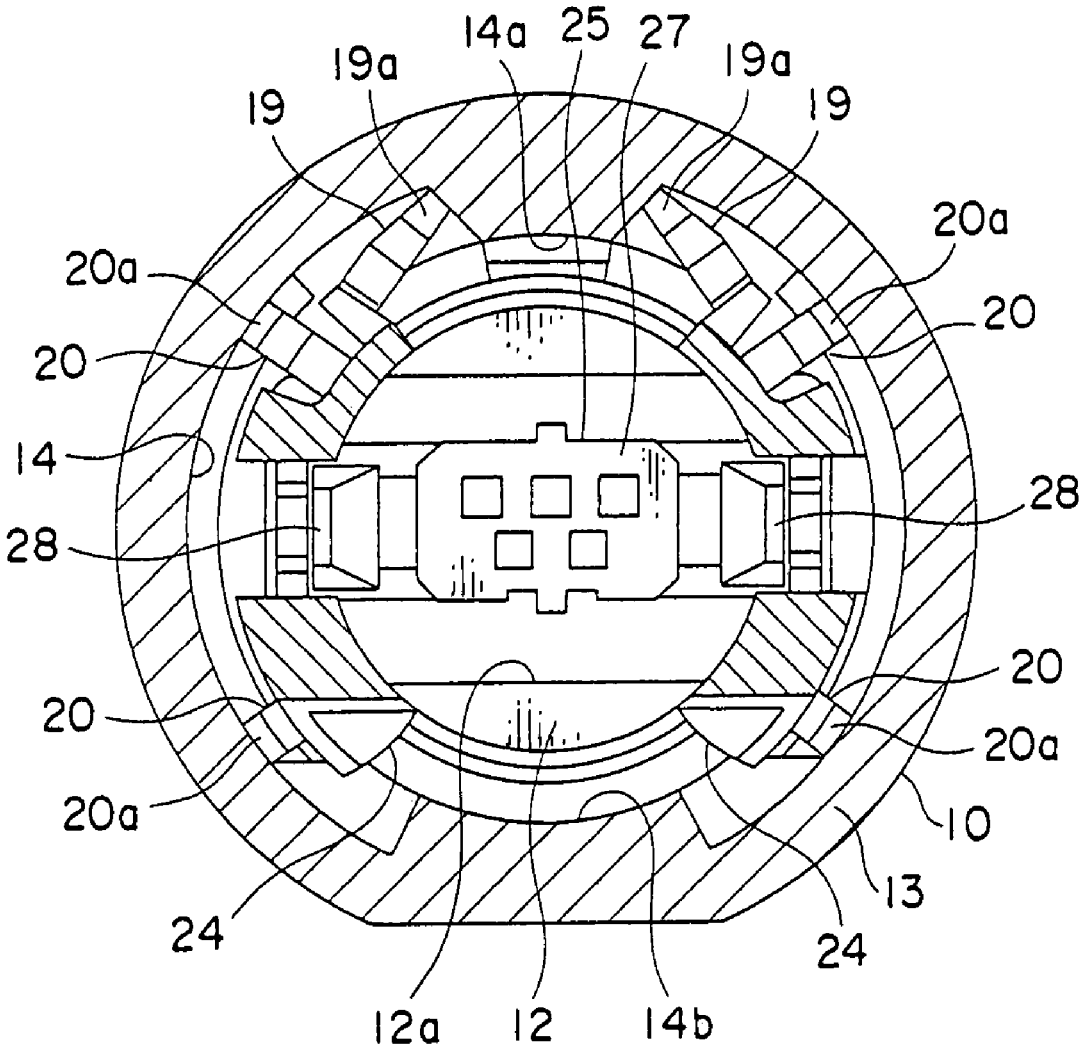
FIG. 6 is a cross-sectional view taken along line VI-VI of FIG. 5.

The bracket 2 is made of an insulation synthetic resin, and includes a plate shaped main body 8 and a pair of receiving portions 9. The main body 8 is communicated with the pair of receiving portions 9. The receiving portions 9 are disposed parallel to each other at a distance, and include a receiving portion main body (receiving member) 10 and a flange 11. Referring to FIGS. 5-6, the receiving portion main body 10 includes an annular bottom plate 12 and a tube portion 13 upstanding from an outer edge of the bottom plate 12 to receive therein and hold the holder 3.

Figure 4:
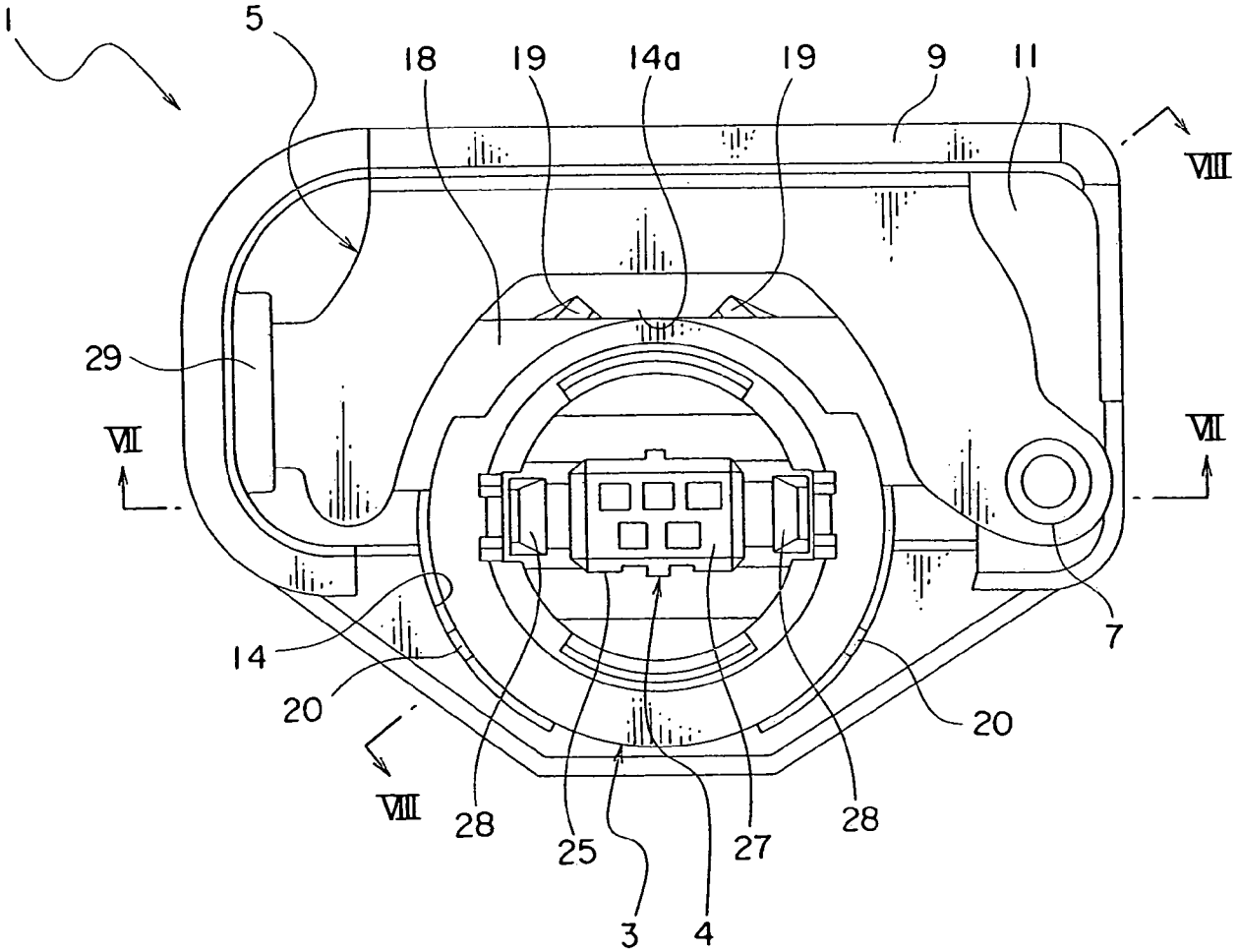
FIG. 4 is a plan view of a receiving portion of the connector connection apparatus of FIG. 1.

The flange 11 has a flat shape, and is disposed around at an upper opening of the tube portion 13 of the receiving portion main body 10. The flange 11 extends only half of an outer edge of the tube portion 13, and has a step portion 15 to increase the thickness thereof. The flange 11 has a bolt hole (fixing portion) 16 and a nut at an end portion close to the main body 8. The nut is communicated with the bolt hole 16. The bolt 7 is inserted into a plate bolt hole 6, which is disposed on the plate 5, and the bolt hole 16 to fasten the plate 5. Referring to FIG. 4, the flange 11 has a locking portion 29 at an opposite side of the main body 8 to lock one end portion of the plate 5.

As shown in FIG. 5, the bottom plate 12 has a lower opening 12*a* to receive the connector 4 in the holder 3 received in the receiving portion main body 10. The holder 3 received in a receiving hole 14 or the receiving portion main body 10 rests on a surface of the bottom plate 12 and is held with the bottom plate 12 and the plate 5.

As shown in FIG. 2, the tube portion 13 has the receiving hole 14 to receive the holder 3, and an abutment rib 14*a* and a restraint rib 14*b* protruding inwardly from an inner wall thereof. The abutment rib 14*a* and the restraint rib 14*b* are opposed to each other. The abutment rib 14*a* is disposed on the side of the flange 11 and the restraint rib 14*b* is disposed opposite thereto. The tube portion 13 is connected with the outer edge of the bottom plate 12.

The holder 3 is inserted into the receiving hole 14 in a direction K indicated in FIG. 2.

The holder 3 is made of an insulation synthetic resin and has as a whole a tube shape. The holder 3 is integral with a tube-shaped holder main body 17, a holder flange 18, a plurality of cutouts, and a hole. The holder 3 has an outer diameter smaller than a diameter of the receiving hole 14, so that the holder 3 is freely movable inside the receiving portion main body 10 by virtue of a gap therebetween. The height of the holder main body 17 is same as a depth of the receiving hole 14.

Referring to FIGS. 2 and 6, the holder main body 17 includes a pair of first positioning arms 19, two pairs of second positioning arms 20, a pair of holder locking arms (engaging arm) 21, a pair of restraint portions 24, and a connection portion 30. The first positioning arms 19 are disposed on a side of the holder flange 18. The first positioning arms 19 are resiliently deformable and rod-shaped. The first positioning arms 19 each are connected to the holder main body 17 at one end thereof and have an abutment piece 19*a* at the other end thereof. The abutment pieces 19*a* project each other toward a direction to which the first positioning arms 19 become close each other. The abutment pieces 19*a* are resiliently deformable toward a direction parallel to an outer circumference of the holder main body 17.

When the holder main body 17 is received in the receiving hole 14 of the tube portion 13, the abutment pieces 19*a* of the first positioning arms 19 abut on the abutment rib 14*a* disposed on the inner wall of the tube portion 13. The rotation of the holder main body 17 about the axis thereof in the receiving hole 14 causes the abutment pieces 19*a* to abut on the associated abutment ribs 14*a* in accordance with a direction of rotation and resiliently deform.

The first positioning arms 19 thus support movably and urge about the axis the holder 3 in the receiving portion main body 10.

Figure 8:
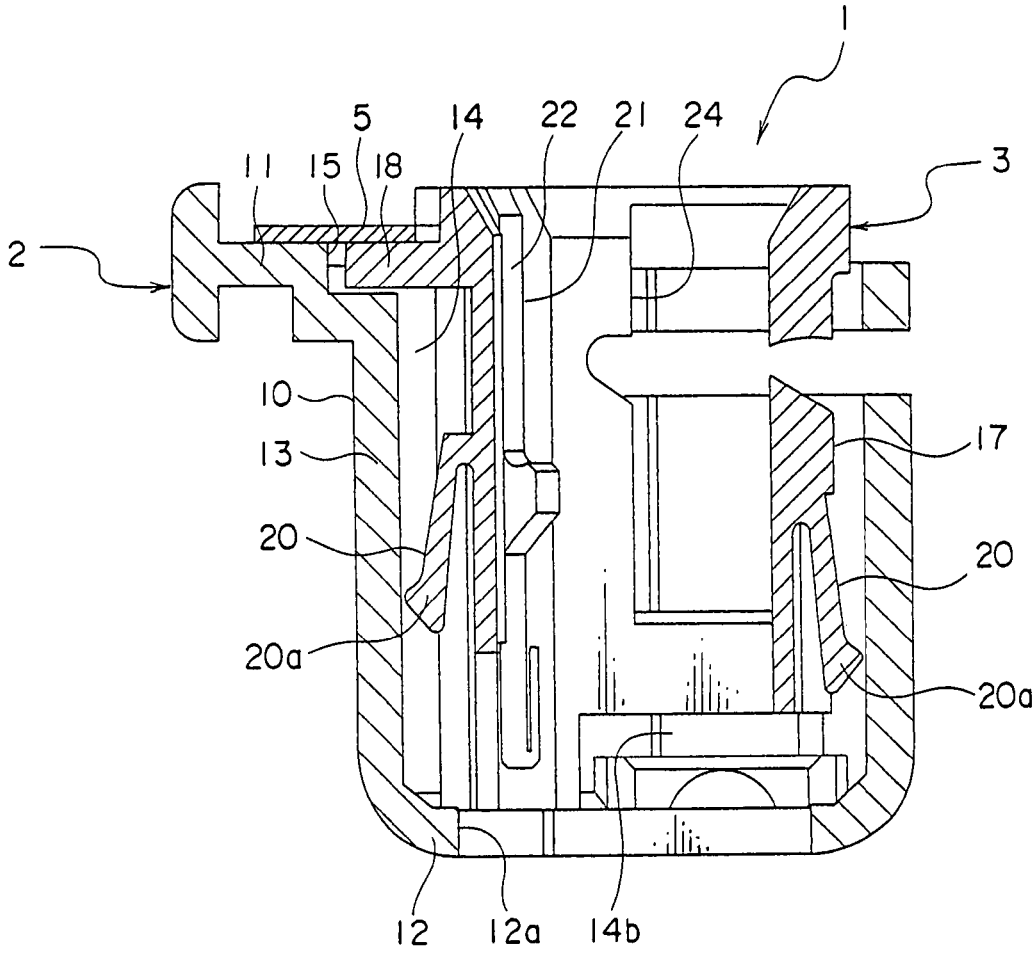
FIG. 8 is a cross-sectional view taken along line VIII-VIII of FIG. 4.

Referring to FIGS. 6 and 8, the four second positioning arms 20 are separately disposed around the holder main body 17 and project outwardly from the outer surface of the holder main body 17. The plurality of second positioning arms 20 are resiliently deformable and rod shaped. The second positioning arms 20 each have one end portion connected to the holder main body 17 and an abutment projection 20*a* at the other end thereof, and resiliently deformable with respect to the holder main body 17. The abutment projections 20*a* protrude in a radial direction of the holder main body 17.

When the holder main body 17 is received in the receiving hole 14, the abutment projections 20*a* of the second positioning arms 20 abut on the inner wall of the tube portion 13 and are resiliently deformable. The second positioning arms 20 thereby support movably the holder main body 17 in the radial direction and urge the holder main body 17 toward the center of the receiving portion main body 10.

Referring to FIGS. 2 and 6, the pair of restraint portions 24 are disposed on the holder main body 17 opposite to the holder flange 18. The restraint portions 24 are inner edges of cutouts disposed on the holder main body 17. The restraint portions 24 are opposite to the first positioning arms 19 about the center of the holder main body 17 and are opposed to each other in the outer circumference direction of the holder main body 17. When the holder main body 17 rotates about the center axis thereof by a certain angle, the each restraint portion 24 abuts on the restraint rib 14*b* in accordance with the direction of rotation. The restraint portions 24 thereby restrain the angle of rotation of the holder 3 in the receiving portion main body 10.

Referring to FIG. 2, the pair of holder locking arms 21 are disposed opposite to each other with respect to the center of the holder main body 17. The holder locking arms 21 each have an arm main body 22 and a locking projection 23. The arm main bodies 22 extend parallel to the axis of the holder main body 17. Both ends of the arm main bodies 22 are integral with the holder main body 17 and the rest portions thereof are separated from the holder main body 17. The locking projections 23 are disposed on the intermediate portions of the arm main bodies 22 in the longitudinal direction thereof and opposed to each other inwardly from inner surfaces of the arm main bodies 22. The arm main bodies 22 are connected together with the connection portion 30 in a fashion of beam.

The holder flange 18 is disposed on an upper portion of the holder main body 17 and positioned at the same side of the flange 11 of the receiving portion main body 10. The holder flange 18 covers substantially a half of an outer periphery of the upper portion of the holder main body 17, and has a thickness same as the height of the step portion 15 of the flange 11.

When the holder 3 is received in the receiving portion main body 10, the holder flange 18 is superposed on the flange 11. The holder main body 17 receives the connector 4, and the holder locking arms 21 and connector locking arms 28 described below are engaged together to hold the connector 4. The holder flange 18 is positioned on a lower portion of the step portion 15.

The connector 4 includes terminals, not shown, and a connector housing 25, as shown in FIG. 2. The terminals are made of a conductive metal plate and electrically connected to electrical wires 26.

The connector housing 25 is made of an insulation synthetic resin, and has a box-shaped housing main body 27 and the locking arms 28. The housing main body 27 has a plurality receiving chambers linearly extending parallel to each other, and has openings at both ends thereof.

The connector 4 has the pair of locking arms 28 at both sides thereof. The locking arms 28 are formed in a plate shape and disposed parallel to the terminal receiving chambers. The locking arms 28 are connected to the housing main body 27 at one ends thereof. The other ends of the locking arms 28 engage the locking projections 23 of the holder locking arms 21 and engage locking projections of a mating connector, not shown. The connector 4 is inserted into the lower opening 12*a* of the bottom plate 12 indicated by an arrow S in FIGS. 1 and 5, and received into the holder main body 17.

The plate 5 made from a thick metal plate has the plate bolt hole 6 at the one end portion. The other end portion is locked to the locking portion 29 of the flange 11. The plate 5 is communicated with the plate bolt hole 6 and the bolt hole 16 of the flange 11.

The plate 5 thereby holds the holder flange 18 with the flange 11 of the receiving portion 9. The plate 5 is secured to the flange 11 with the bolt 7 screwed into the nut through the bolt holes 6, 16. The plate 5 thus fixes the holder 3 to the receiving portion 9 along the direction K as seen in FIG. 2.

Assembly of the connection apparatus 1 is described below. The holder main body 17 is inserted into the upper opening of the tube portion 13 in the K direction. The holder flange 18 is superposed on the flange 11 so that the receiving portion 9 can support the holder 3. The plate 5 is superposed on the holder flange 18 and secured with the bolt 7 to the flange 11 of the receiving portion 9.

Figure 3:
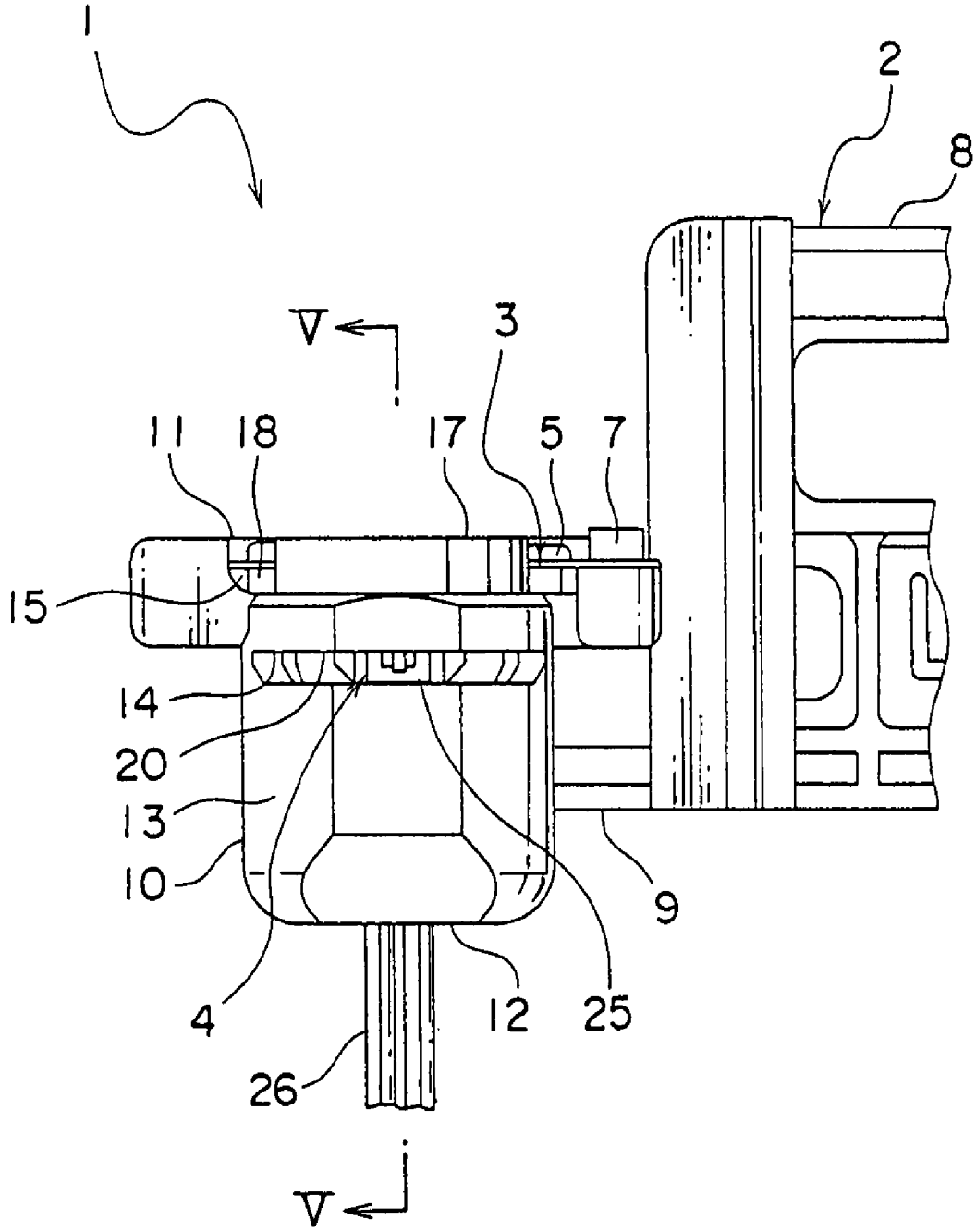
FIG. 3 is a front view of the connector connection apparatus of FIG. 1.
Figure 7:
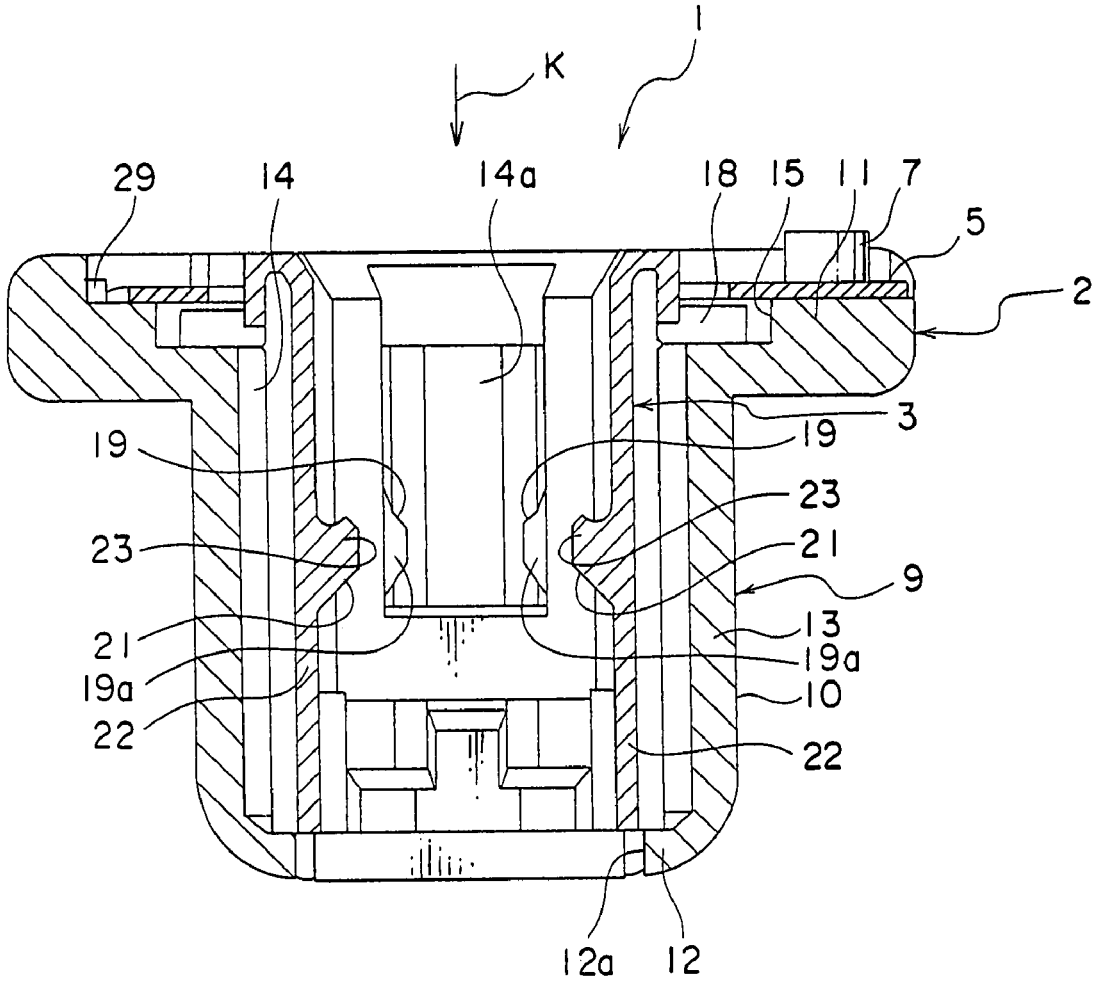
FIG. 7 is a cross-sectional view taken along line VII-VII of FIG. 4.

The connector 4 is inserted from the lower opening 12*a* at the bottom plate 12 into the holder main body 17 as shown in FIGS. 2 and 3 to assemble the connection apparatus 1. The holder main body 17 of the holder 3 is positioned between the bottom plate 12 and the plate 5 as shown in FIGS. 7-8.

The abutment pieces 19*a* of the first positioning arms 19 abut on the abutment rib 14*a* so that the holder 3 is positioned about the central axis of the receiving portion main body 10. The abutment projections 20*a* of the second positioning arms 20 abut on the inner wall of the tube portion 13 so that the holder 10 is positioned with respect to the radial direction of the receiving hole 14.

The restraint portions 24 abut on the restraint rib 14*b* disposed on the inner wall of the tube portion 13 so that the holder 3 is restrained about the rotational angle with respect to the central axis, or a fitting axis.

The connector 4 of the connection apparatus 1 is fitted with a connector of the mating connector, not shown, which also has terminals and a connector housing made of an insulation synthetic resin. The terminals are connected with the electronic apparatus such as the monitor or the whiplash preventing apparatus. The mating connector has locking projections to be engaged with the locking arms 28 of the connector 4.

The connection apparatus 1 is attached to a seat with the bracket 2. The mating connector attached to the headrest is approached to and connected with the connector 4. The holder 3 is rotatable and movable in the receiving portion main body 10 so that the connector 4 is appropriately moved to fit the mating connector. The receiving portion main body 10 thereby allows the both connectors to fit together in the receiving hole 14. The connection apparatus 1 thereby connects between the electronic apparatus of the vehicle main body and the electronic apparatus attached to the headrest, and supplies a desired electrical power and signal to the electronic apparatus of the headrest.

The receiving portion main body 10 has the inner diameter larger than the outer diameter of the holder main body 17 so that the holder 3 can assuredly move in the receiving hole 14. The holder flange 18 is held between the plate 5 and the receiving portion main body 10 to avoid drop of the holder 3 from the receiving portion main body 3. The inner wall of the tube portion 13 and the outer wall of the holder 3 can be simplified without additional cost.

The one end portion of the plate 5 is held with the locking portion 29 of the flange 11 to provide a simple attachment with low cost.

The holder 3 is movable in the receiving hole 14 to be positioned for relevant connection between the connectors 4. The connector 4 is assuredly connected to the mating connector.

The bottom plate 12 disposed on the receiving portion main body 10 assuredly prevents drop of the holder 3, or the connector 4.

The holder 3 is inserted from the upper opening of the tube portion 13 into the receiving hole 14 without any restriction, and is assuredly held between the bottom plate 5 and the plate 5 so as to avoid drop of the holder 3 receiving the connector 4 without increase of cost.

The connection portion 30 connecting the holder locking arms 21 engaging the connector 4 keeps rigidity of the holder 3 and assuredly prevents drop of the connector 4 from the holder locking arms 21.

The embodiment discloses the connector connection apparatus 1 attached to the seat to supply the electrical power or signal to the electronic apparatus attached to the headrest. The present invention is adapted not only the embodiment but also products except with the seat, headrest, or motor vehicle to supply the electrical power or signal to the desired electronic apparatus.

The embodiment disclosed is only purely exemplary and not limited thereto. Any modification and alteration are within the spirit and scope of the present invention.

What is claimed is:

1. A connector connection apparatus comprising:

a holder, having a holder flange, for receiving therein and holding a connector;

a receiving member for receiving therein and holding the holder; and a fixing member in the shape of a flat plate, for fixing the holder attached to the receiving member, wherein the receiving member has a receiving hole with a diameter larger than an outer diameter of the holder by a gap for receiving the holder, and a receiving member flange disposed about the receiving hole, the holder is insertable through an upper opening of the receiving hole into the receiving member, and the fixing member is attachable to the receiving member so as to fix the holder flange between the fixing member and the receiving member flange in the insertion direction of the holder.

2. The connector connection apparatus as claimed in claim 1, wherein the receiving member has a bottom plate for holding the holder with the fixing member, the bottom plate being connected with a lower opening of the receiving hole.

3. The connector connection apparatus as claimed in claim 1, wherein the holder is movable in the receiving hole when the connector is connected to a mating connector.

4. The connector connection apparatus as claimed in claim 3, wherein the connector is disposed on a seat and the mating connector is disposed on a headrest.

5. A connector connection apparatus comprising:

a holder, having a holder flange, for receiving therein and holding a connector;

a receiving member for receiving therein and holding the holder; and a fixing member for fixing the holder attached to the receiving member, wherein the receiving member has a receiving hole with a diameter lamer than an outer diameter of the holder by a gap for receiving the holder, the holder is insertable through an upper opening of the receiving hole into the receiving member, and the fixing member is attachable to the receiving member so as to fix the holder between the fixing member and the receiving member in the insertion direction of the holder, and wherein the receiving member includes a locking portion for locking one end portion of the fixing member and a fixing portion for fixing another end portion of the fixing member with a bolt.

6. A connector connection apparatus comprising:

a holder, having a holder flange, for receiving therein and holding a connector;

a receiving member for receiving therein and holding the holder; and a fixing member for fixing the holder attached tote receiving member, wherein the receiving member has a receiving hole with a diameter larger than an outer diameter of the holder by a gap for receiving the holder, the holder is insertable through an upper opening of the receiving hole into the receiving member, and the fixing member is attachable to the receiving member so as to fix the holder between the fixing member and the receiving member in the insertion direction of the holder, and wherein the holder includes a pair of engaging arms disposed with a distance for engaging the connector, and a connection portion for connecting the engaging arms together.

* * * * *